United States Patent [19]

Ettinger

[11] 4,123,814

[45] Nov. 7, 1978

[54] FLOTATION DEVICE

[75] Inventor: Donald N. Ettinger, Knoxville, Tenn.

[73] Assignee: Ettinger Enterprises, Inc., Knoxville, Tenn.

[21] Appl. No.: 817,270

[22] Filed: Jul. 20, 1977

[51] Int. Cl.[2] ..... B63C 9/08

[52] U.S. Cl. ..... 9/337

[58] Field of Search ..... 9/311, 329, 336, 337, 9/341, 342

[56] References Cited

U.S. PATENT DOCUMENTS

| | | | |
|---|---|---|---|
| 3,360,814 | 1/1968 | Scheurer | 9/342 |
| 3,400,415 | 9/1968 | Scheurer | 9/342 |

*Primary Examiner*—Trygve M. Blix
*Assistant Examiner*—Jesus D. Sotelo
*Attorney, Agent, or Firm*—Jenkins, Coffey & Hyland

[57] ABSTRACT

A water safety device of buoyant material is fitted by waist measurement around the mid-section of the wearer to provide flotation. Contoured ribs of buoyant material on the inner side of the device fit under the wearer's ribs, and openings in various portions of the device provide stabilization of the position of a wearer when in the water. When the wearer is in an essentially upright position, the entire body of the device is under water, thus fully utilizing the buoyancy of the device.

4 Claims, 5 Drawing Figures

FLOTATION DEVICE

This invention relates to flotation devices and more particularly to life preserving flotation devices for use by humans. These devices are useful safety aids for people in and around water, such as boaters, fishermen, water skiers, etc.

Numerous life vests, life jackets, and similar water safety devices have been used for years, some of an inflatable type. More recently, buoyant devices made from closed cell foam materials have been in use. Though not subject to puncture, such devices are often bulky and uncomfortable to the wearer. Often, when in the form of a vest or jacket, they interfere with the wearer's arm movement, and when the wearer is in the water, they often rise or ride-up on the wearer's body causing significant impairment of the use of arms. Moreover, such devices often rise around the wearer's head, often interfering with or covering the person's mouth and nose. The loose fitting devices allow water to enter the space between the device and the wearer's body, causing significant drag when attempting to swim. The restrictions on arm movement also interferes with swimming.

In addition to the discomfort and loss of mobility to the wearer, when the wearer is floating in the water, a significant portion of those devices is not even under the water. The buoyancy provided by a flotation device is proportional to the volume of water it displaces. The usable buoyancy of such devices decreases significantly as parts of the vest or jacket rise out of the water.

Although many commercially available life preservation devices have been approved for use by the United States Coast Guard, they nevertheless suffer such defects in utility, comfort and convenience. All too often these defects militate against the use of such devices. And all too often such non-use has disastrous consequences.

This invention provides a flotation device which is comfortable to wear, will not interfere with a person's arms or face when in or out of the water, will not ride-up on the wearer's body, will not allow significant water between the device and the wearer's body, and will provide sufficient usable buoyancy to maintain the wearer in a safe position in the water. The device is comfortably fitted to both male and female wearers on the basis of the wearer's waist measurement. By solving many of the functional defects which plague current commercial devices, this invention also helps to overcome the human opposition to their use.

This invention is illustrated in the accompanying drawings in which.

Figure 1:
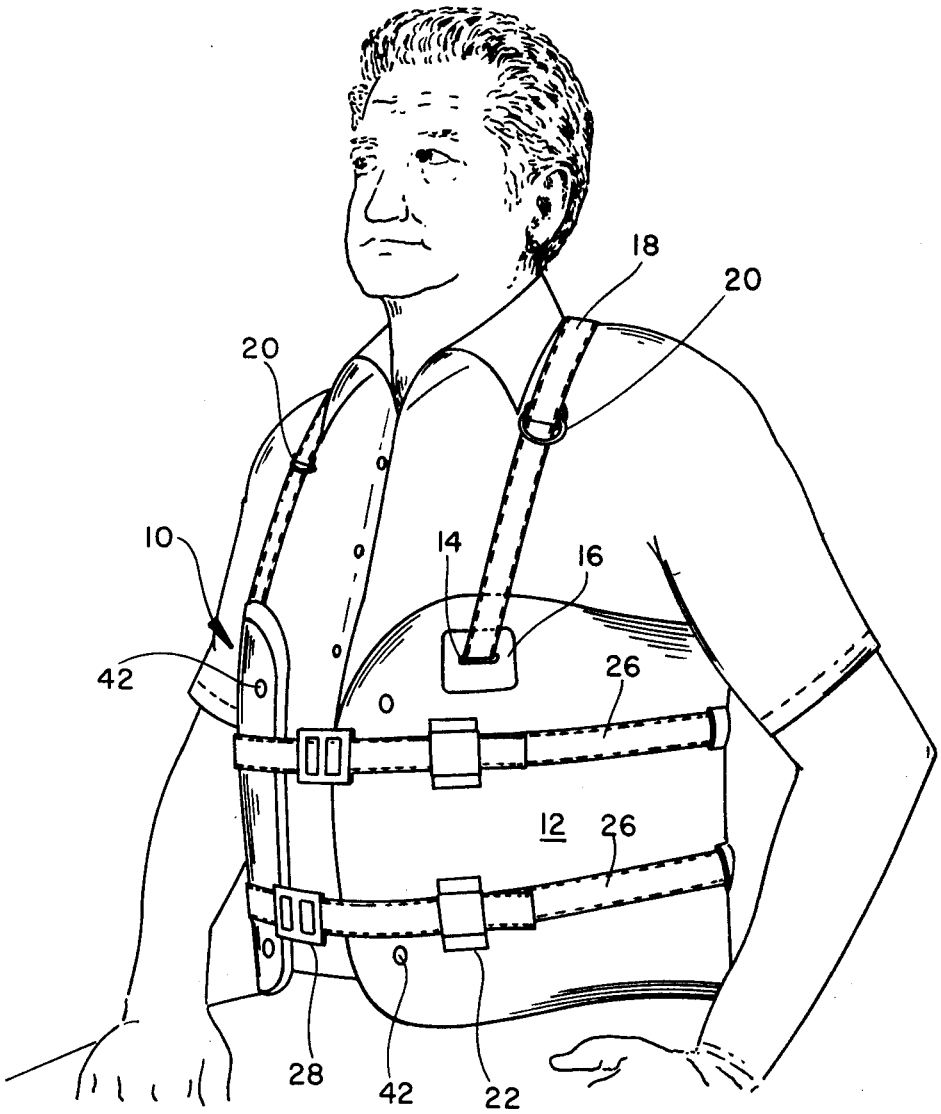
FIG. 1 is a perspective view of the flotation device being worn by a person.

A flotation device is illustrated generally by the reference numeral 10. The device has a main body 12 made of a buoyant material, preferably a closed cell material such as Ensolite. The body 12 may be a unitary stamped piece covered with vinyl.

The size and shape of the body 10 are such that the device will fit substantially around the wearer's midsection and extend from about the waist to somewhere near but beneath the underarm area. The device is fitted to the wearer by the wearer's waist measurement. A properly sized device will fit snugly and comfortably on men or women without causing discomfort to women's breasts.

Four slots 14 are provided in the body in reinforced portions 16. Shoulder straps 18 fit through the slots 14. D-rings 20 allow for adjustments in the length of the shoulder straps.

Figure 2:
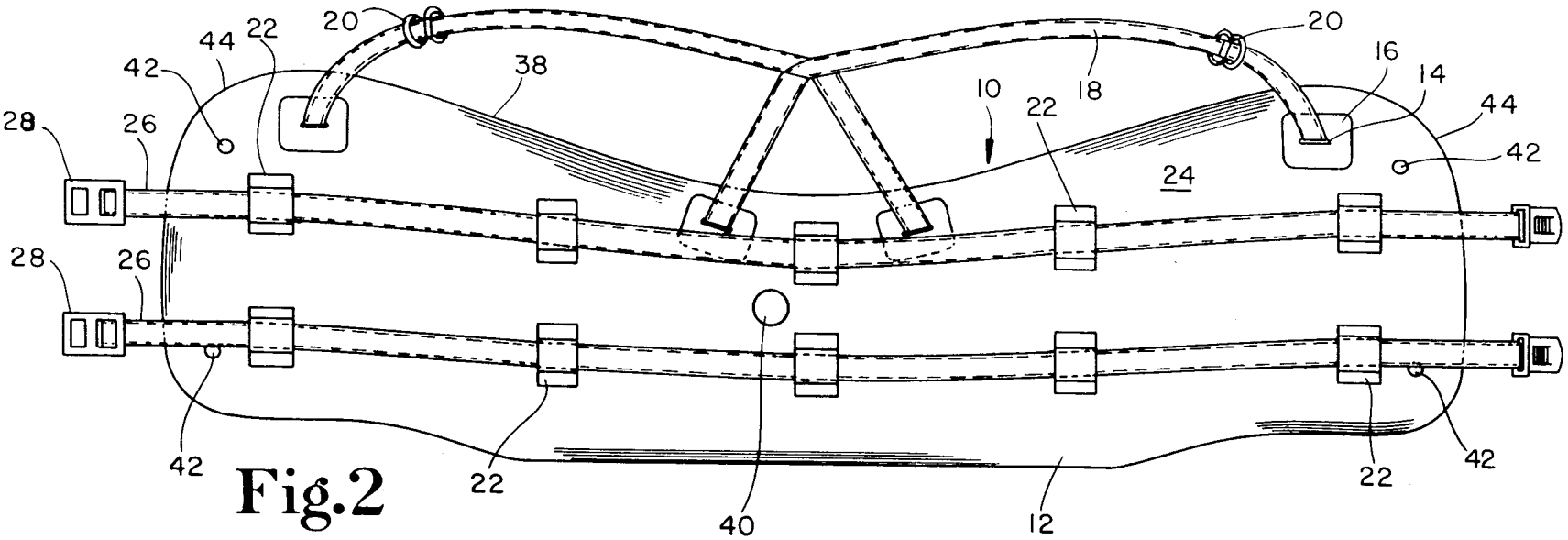
FIG. 2 is a plan view of the outer side of the flotation device.

As shown in FIG. 2, belt loops 22 are attached to the outside surface 24 of the body 12 at spaced intervals. Straps 26, having a length greater than the length of the body, pass through the loops 22 and extend beyond the ends of the body 12. The ends of the straps 26 are provided with fastening means, such as quick-release rust-proof buckles 28.

Figure 3:
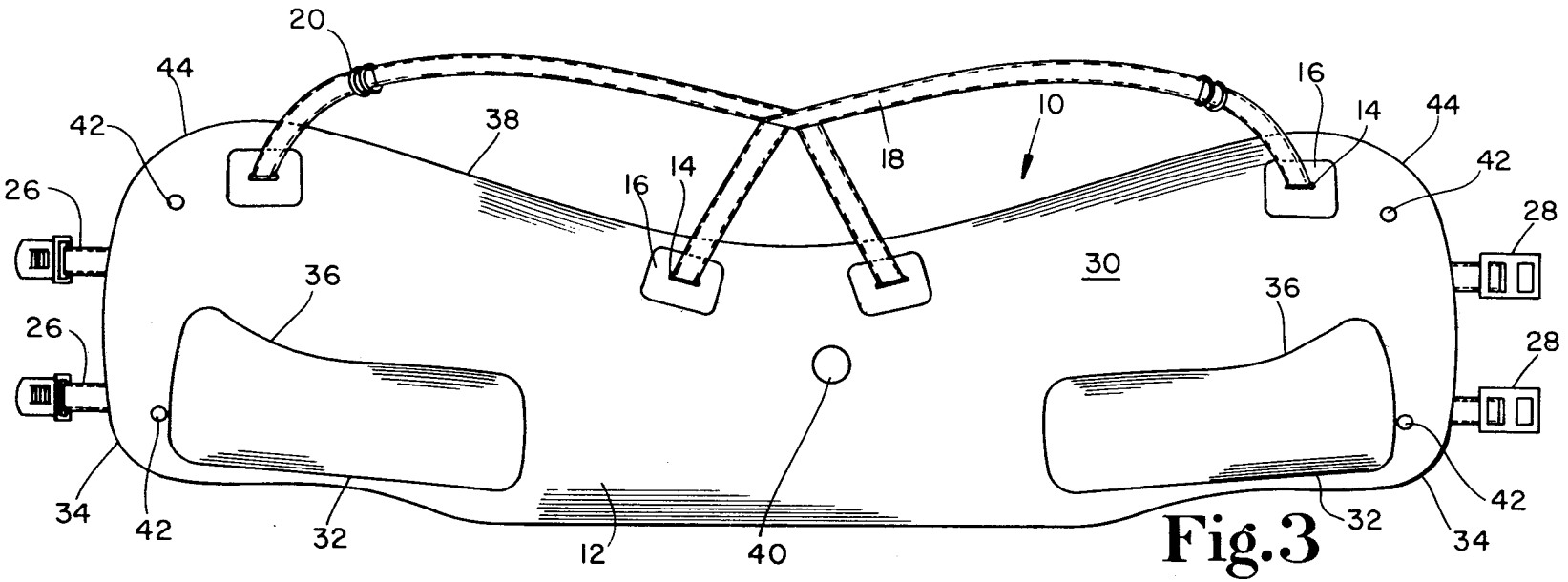
FIG. 3 is a plan view of the inner side of the flotation device.

The inside surface 30 of the body, as shown in FIG. 3, has ribs 32 of buoyant material protruding inwardly and located adjacent to its lower ends 34. The ribs 32 are of approximately the same thickness as the body 12. The upper portions of each of the ribs 32 are contoured as at 36, so as to conform to the shape of the ribs of a person wearing the device. Thus the top or upper contoured portion 36 of the ribs 32 will fit generally along and under the lower ribs of the wearer.

When the device is being worn, the ribs 32 are positioned along the front and sides of the wearer's body, generally under the person's lower ribs. This fit tends to hold the device in place on the wearer, and helps prevent the device from riding up on the wearer, a common problem with conventional life vests and jackets. The top portion 38 of the body fits somewhere beneath the underarms of the wearer. This limits the distance which the device can rise on the wearer's body. Thus at all times, both in and out of the water, the wearer's arms are free of restraint and there is no danger of the device rising up around the wearer's face and head. The ribs 32 also provide an additional protective cushion for the wearer's body. Such protection is particularly desirable when water skiing.

The entire body 12 and the ribs 32 provide buoyancy for the wearer. And unlike the conventional vests and jackets, the entire device is normally under water when the wearer is in the water. Only when the wearer is floating on his back is any appreciable portion of the device out of the water. This device therefore provides a greater usable buoyancy than is normally the case with conventional vests and jackets. The additional buoyancy provided by the ribs 32 in the front portion of the device aids in lifting a person's head and shoulders up out of the water.

Merely providing additional frontal buoyancy, however, does not assure proper positioning of a person in the water. Desired positioning of a person in the water requires balancing the buoyancy. Buoyancy stabilization means are provided for that purpose. A main buoyancy stabilization opening 40 is formed in and extends through the body 12. The opening 40 is located near but slightly offset from the center of the body 12. Additional stabilization openings 42 are formed in and extend through the body 12 adjacent to each of the upper ends 44 and lower ends 34 of the body. These openings reduce the buoyancy, and by proper sizing and location, serve to stabilize the position of the wearer when in the water.

Figure 4:
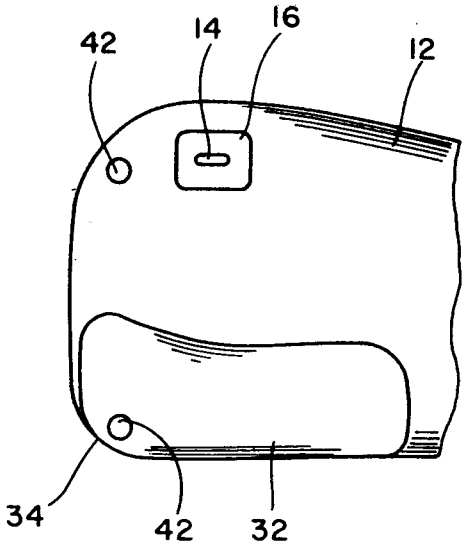
FIG. 4 is a partial view of the inner side of the device illustrating an alternative embodiment; and, FIG. 5 is an end view of the device shown in FIG. 4.
Figure 5:
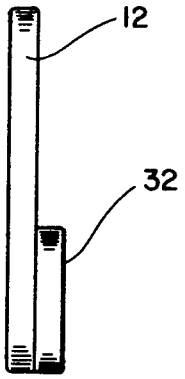

Since the buoyancy of a person's body is related to his size and weight, variations in the thickness and location of the ribs 32 is sometimes desirable. As illustrated in FIGS. 4 and 5, the ribs 32 may be located at the ends of the body 12 and at its lower edge. When so located, one of the buoyancy stabilization openings 42 passes through each of the ribs 32. The use of thicker ribs 32 and the placement of the ribs immediately adjacent to the ends of the body is desirable in devices designed to be worn by smaller or less-buoyant persons. The thicker ribs provide greater buoyancy, and their location at the ends of the body properly locates them with respect to the wearer's ribs.

Prototype flotation devices according to this invention have been subjected to rigorous testing and have been approved for use by the United States Coast Guard. Such devices were made of vinyl covered Ensolite, with the body three-fourths inch thick and the ribs three-fourths inch thick. The main stabilization opening was one and five-eighths inch in diameter, and the four additional stabilization openings were each three-fourths inch in diameter. Other devices, constructed according to the embodiment illustrated in FIGS. 4 and 5, used ribs of seven-eighths inch thickness and a body of three-fourths inch thickness, with the size of the stabilization openings being the same as before.

What is claimed is:

1. A flotation device comprising a body of buoyant material, said body being of a size and shape to be worn generally about a person's mid-section and entirely beneath the underarm areas of the wearer, a rib of buoyant material located adjacent to the front portion of said body when being worn, said rib protruding inwardly from and extending horizontally along the inside surface of said body of buoyant material, said rib having an upper portion which extends along and under and in close proximity to the lower rib of the person wearing the device, said body of buoyant material being entirely under water when the person is in the water in a generally upright position.

2. A flotation device comprising a body of buoyant material, said body being of a size and shape to fit substantially around a person and extend from about the person's waist to beneath and near the underarms, buoyancy stabilization means, ribs of buoyant material located on the inside surface of said body and adjacent to each of the lower ends of said body so as to be adjacent to the front portions of said body when being worn, said ribs protruding inwardly from and extending horizontally along said inside surface, said ribs each having a top portion contoured so that the top of each rib fits generally along and under the lower ribs of the wearer, means for fastening the body in position when being worn, whereby the top of each rib will catch on the lower rib of the person wearing the device to prevent the device from riding up on the wearer's body.

3. A flotation device as set forth in claim 2 wherein said buoyancy stabilization means comprises an opening formed in said body slightly offset from the back center portion thereof and additional openings in said body adjacent to each end thereof in the front portion of the body when being worn.

4. A flotation device comprising a body of buoyant material, said body being of a size and shape to fit substantially around a person's mid-section and extend from about the person's waist to near but entirely beneath the underarm area, ribs of buoyant material protruding inwardly from the inside surface of said body and located adjacent to each of the lower ends of said body so as to be adjacent to the front portions of said body when being worn, said ribs extending horizontally along said inside surface from adjacent to the front portions of said body toward the rear portion thereof, the upper portion of each of said ribs being contoured so as to fit generally along and under and in close proximity to the lower ribs of the wearer, a main stabilization opening extending through said body in a position slightly offset from the back center portion of the body, additional stabilization openings extending through said body adjacent to each of the upper front and each of the lower front end portions thereof when being worn, fastening means for securing said body about the wearer, and shoulder straps secured to said body at the front and back portions thereof.

* * * * *